United States Patent [19]

Iytaka et al.

[11] 4,221,864

[45] Sep. 9, 1980

[54] LIGHT-SENSITIVE SILVER HALIDE PHOTOGRAPHIC MATERIALS

[75] Inventors: Tateshi Iytaka; Syunji Matsuo; Toshio Nagatani; Kazuo Takahashi; Takeshi Habu, all of Hino, Japan

[73] Assignee: Konishiroku Photo Industry Co., Ltd., Tokyo, Japan

[21] Appl. No.: 34,689

[22] Filed: Apr. 30, 1979

Related U.S. Application Data

[63] Continuation of Ser. No. 871,399, Jan. 23, 1978, abandoned.

[30] Foreign Application Priority Data

Feb. 1, 1977 [JP] Japan ..... 52-9924

[51] Int. Cl.[2] ..... G03C 1/28; G03C 1/08

[52] U.S. Cl. ..... 430/572; 430/600; 430/567; 430/949

[58] Field of Search ..... 96/95, 67, 107, 109, 96/122

[56] References Cited

U.S. PATENT DOCUMENTS

| | | | |
|---|---|---|---|
| 3,071,465 | 1/1963 | Dersch et al. | 96/109 |
| 3,420,664 | 1/1969 | Dersch et al. | 96/66 |
| 3,592,656 | 7/1971 | Brooks | 96/109 |
| 3,597,213 | 8/1971 | Dersch et al. | 96/109 |
| 3,753,719 | 8/1973 | Sakamoto | 96/122 |
| 3,909,268 | 9/1975 | Baldassarri et al. | 96/109 |
| 3,915,713 | 10/1975 | Shiba | 96/122 |

FOREIGN PATENT DOCUMENTS

| | | | |
|---|---|---|---|
| 2634666 | 2/1977 | Fed. Rep. of Germany | 96/95 |

*Primary Examiner*—Mary F. Downey

*Attorney, Agent, or Firm*—Frishauf, Holtz, Goodman & Woodward

[57] ABSTRACT

Light-sensitive silver halide photographic materials which comprise a support, a hydrophilic colloidal layer coated thereon which contains a silver halide emulsion layer and tetrazolium compounds, said silver halide emulsion layer containing a combination of two types of specific sensitizing dyes.

12 Claims, No Drawings

LIGHT-SENSITIVE SILVER HALIDE PHOTOGRAPHIC MATERIALS

This is a continuation, of application Ser. No. 871,399, filed Jan. 23, 1978 now abandoned.

The present invention relates to a novel light-sensitive silver halide photographic material. Particularly, it relates to a novel lith type light-sensitive silver halide photographic material for obtaining a photographic image with an especially high contrast, high sharpness and high-resolving power.

More particularly, it relates to a novel light-sensitive silver halide photographic material which is applicable advantageously to a light-sensitive silver halide photographic material with a high contrast suitable for forming a dot- or line-image on a lith (printing) light-sensitive silver halide photographic material or a copying light-sensitive silver halide photographic material.

It has been known to form a photographic image with an extremely high contrast by using some kind of a light-sensitive silver halide photographic material (referred to photographic material).

It has been known, for example, to obtain a high contrast image, i.g. a line- or dot-image by treating with an alkaline hydroquinone developing solution containing sulfite ions in a very low concentration, a photographic material which comprises a silver halide emulsion containing silver chloride in a high content (at least more than 50 mole %) and further containing silver iodide less than 5 mole %, the grains of which emulsion being fine (average grain size; ca. 0.2$\mu$). The above-mentioned kind of photographic material is known as the lith type photographic material.

In printing, there is usually required a process to convert a continuous gradation original to a dot image; that is a process to convert the densities of the continuous gradation to a predetermined numbered assembly of dots respectively having areas of the same densities but proportional in size to the densities of the continuous gradation. In order to carry out this, the lith type photographic material is subjected to development, after photographing the original image through a cross- or contact-screen, to form the dot image on the photographic material.

For this purpose there has been employed a photographic material containing a silver halide emulsion, the grains of which being fine and being uniform in size and shape. Even when this kind of a photographic material is employed, the intermediate density region is reproduced, beside the maximum density region and the minimum one (fog), when the photographic material is processed with a standard black and white developing solution. The intermediate density region, the so-called fringe, is undesirable for producing a printing plate and makes the dot quality worse.

There has heretofore been employed the lith type photographic material also for the reproduction of a line image. For the same reason, however, there have been obtained images having at best the nonscreened gradation value (referred to $\gamma$) of 5–6 of the characteristic curve, said $\gamma$ is lower than 7–9 required for forming the desirable line-image, if the standard black and white developing solution is employed. In order to avoid this, there has been employed, as mentioned above, a specific developing solution called "infectious developing solution" or "lith type developing solution".

The infectious developing solution or the lith type developing solution as used herein means a developing solution containing substantially hydroquinone solely as a developing agent and having a low, concentration of sulfite ion, as fully disclosed by J. A. C. Yule in the Journal of the Franklin Institute, Vo. 239, 221 (1945).

As can be expected from the composition, the lith type developing solution shows a poor storability and readily undergoes autoxidation and, hence, a complicated control system is required in order that photographic process manufacturers may usually produce a halftone negative/positive of a high quality.

As it is an extremely advantageous to improve storability of a lith type developing agent, a considerable effort therefor has been made. However, there has not yet been proposed such a developing solution comparable with developing solutions for continuous gradation such as Metol-hydroquinone developing solution and phenidone-hydroquinone developing solution, for example, "Sakuradol" (a Registered Trade Mark) types 311, 411 and 431, nor a process wherein a high dot quality is obtainable.

On the other hand, a photographic material, in order to produce an image of high contrast (e.g., the $\gamma$ is not less than 10), has severe restrictions such that a silver halide should be used which contains not less than 50 mole % of silver chloride with a narrow grain distribution and the majority of which has (100) planes.

It is, therefore, the primary object of this invention to provide a novel photographic material for producing a silver image of high contrast.

Another object of this invention is to provide a novel lith type photographic material containing a tetrazolium compound, being color-sensitized and suitable for obtaining a dot- or line-image and having a broadened exposure-range.

Still another object of this invention is to provide a novel lith type photographic material causing no fatigue effects on a developing solution.

After extensive studies to accomplish these and other objects, the present inventors have found that the objects can be attained by preparing a photographic material which comprises a support and at least one light-sensitive silver halide emulsion layer and another hydrophilic colloidal layer coated on the support, one of which said silver halide emulsion layer and another hydrophilic colloidal layer, containing a salt of tetrazolium and at least one of silver halide emulsion layer further containing at least one of the compound represented by general formula (I) and at least one of the compound represented by general formula (II). The general formula (I)

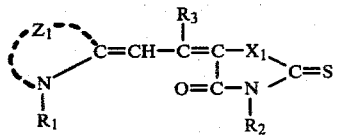

(I)

wherein $Z_1$ represents a group of non-metallic atoms which is required to form a thiazole ring, a selenazole ring, an oxazole ring, an imidazole ring, a benzthiazole ring, a benzselenazole ring, a benzoxazole ring, a bensimidazle ring, a naphthothiazole ring, a naphthoselenazole ring, a naphthoxazole ring or a naphthoimidazole ring, each of the said rings being unsubstituted or substituted, and a substituent may be, for example, an alkyl group (e.g. methyl, ethyl and the like), a halogen atom (e.g. a chlorine atom, a bromine atom and the like), an alkoxy group (e.g. methoxy, ethoxy and the like), an aryl group (e.g. phenyl, tolyl, hydroxyphenyl and the like), a carbonyl group (e.g. a phenylcarbonyl and the like) and so on; $X_1$ represents an oxygen atom, a sulfur atom, a selenium atom or a group of N-$R_4$ in which $R_4$ is a lower alkyl group (preferably 1 to 4 carbon atoms e.g. methyl, ethyl, propyl, hydroxyethyl, carboxyethyl and the like), an alkenyl group (e.g. allyl and the like) or an aryl group (e.g. phenyl, hydroxyphenyl, tolyl and the like); $R_1$ and $R_2$ individually represent a lower alkyl group (preferably 1 to 4 carbon atoms e.g. methyl, ethyl, butyl, benzyl, hydroxyethyl, carboxypropyl, a lower alkyl substituted with a sulfonic acid and the like), an alkenyl group (e.g. allyl and the like), an aryl group (e.g. phenyl, tolyl, hydroxyphenyl, carboxyphenyl and the like); and $R_3$ represents a hydrogen atom, a lower alkyl group (preferably 1 to 4 carbon atoms e.g. methyl, ethyl, hydroxyethyl and the like), an alkenyl group (e.g. allyl and the like) or an aryl group (e.g. phenyl group and the like). The general formula (II)

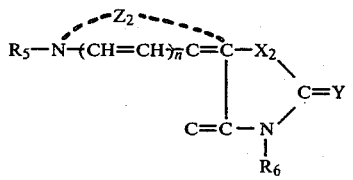

(II)

wherein $Z_2$ represents a group of non-metallic atoms which is required to form a 5- or 6-membered heterocyclic ring optionally having a substituent and the said heterocyclic ring may be, for example, a pyridyl, ring a quinolyl ring, a thiazole ring, a selenazole ring, an oxazole ring, an imidazole ring and the like; $X_2$ represents an oxygen atom, a sulfur atom, a selenium atom or a group of N-$R_7$ in which $R_7$ represents a lower alkyl group, an alkenyl group or an aryl group and examples of the said groups are the same as $R_4$; Y represents an oxygen atom or a sulfur atom; $R_5$ and $R_6$ individually represent a lower alkyl group, an alkenyl group or an aryl group, examples of $R_5$are the same as $R_1$ and examples of $R_6$ are the same as $R_2$; and n is 0 or 1.

As the compounds having the above-mentioned general formulae (I) and (II) are usually known as sensitizing dyes in the field of a silver halide photography, the compounds having the general formulae (I) and (II) are hereinafter referred to as "sensitizing dye" of this invention. However, this invention can unexpectedly provide a photographic material which has excellent effects such as a sensitizing effect on the so-called silver halide, a prolonged exposure-range, no fatigue effect on a developing solution and so on.

In accordance with this invention, the sensitizing dyes of this invention can exert excellent effects as stated above by a specific combination of the compound having the above general formula (I) with the compound having the above general formula (II). As a more preferable combination of sensitizing dyes, there can be mentioned a combination of at least one of the compounds having the under-mentioned general formula (III), which are within the compounds of the general formula (I), with at least one of the compounds having the under-mentioned general formula (IV) or the compounds having the under-mentioned general formula (V), which are within the compounds of the general formula (II). The general formula (III)

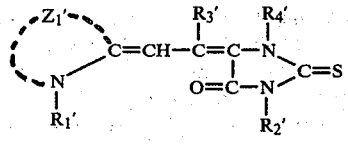

(III)

wherein $Z_1'$ represents a group of non-metallic atoms which is required to form a benzoxazole ring, the substituent of a benzoxazole ring being, for example, an alkyl group (e.g., methyl, ethyl and the like), a halogen atom (e.g., a chlorine atom, a bromine atom and the like), an alkoxy group (e.g., methoxy, ethoxy and the like), an aryl group (e.g., phenyl, tolyl, hydroxyphenyl and the like), a carbonyl group (e.g., carboxyphenyl and the like) and so on; $R_1'$ represents a lower alkyl group as defined in the general formula (I); $R_2'$ and $R_4'$ individually represent a lower alkyl group or an aryl group as defined in the general formula (I); and $R_3'$ represents a hydrogen atom or a lower alkyl group or a phenyl group (e.g., phenyl, tolyl, hydroxyphenyl and the like) as defined in the general formula (I). The general formula (IV)

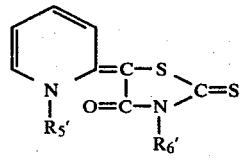

(IV)

The general formula (V)

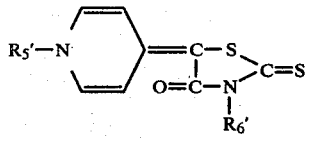

(V)

where $R_5'$ represents a lower alkyl group as defined in the general formula (II) and $R_6'$ represents a lower alkyl group, an alkenyl group or an aryl group as defined in the general formula (II).

The representative sensitizing dyes useful in this invention which are recited hereinbelow, are not intended to limit the scope of this invention.

The representative compounds having the general formula (I) or (III) are as follows:

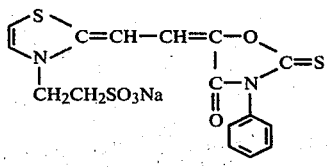

I-1

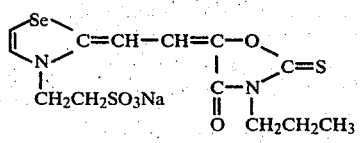

I-2

-continued
I-3
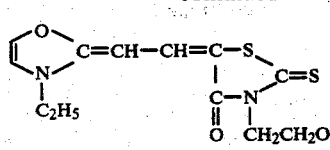
I-4
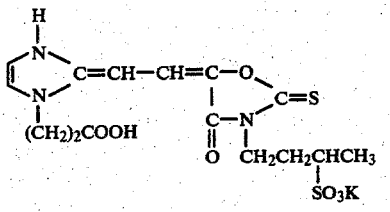
I-5
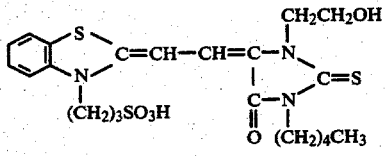
I-6
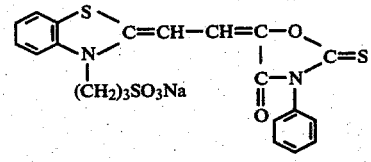
I-7
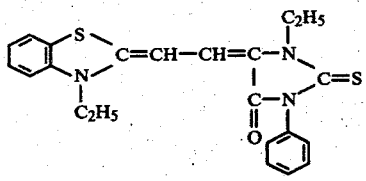
I-8
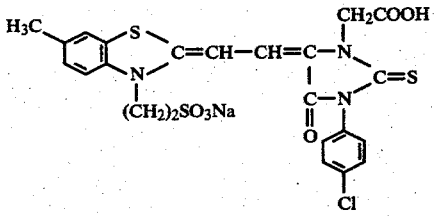
I-9
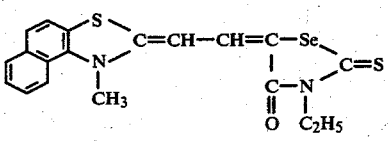
I-10
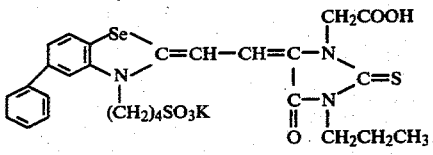
I-11
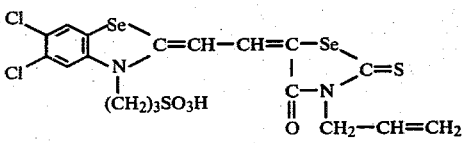
I-12
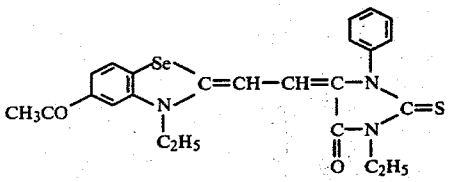
-continued
I-13
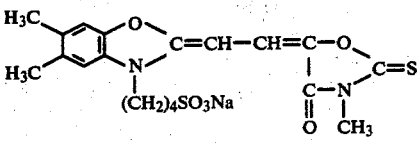
I-14
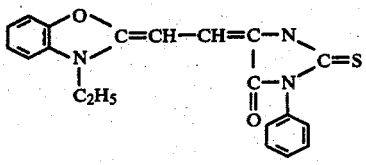
I-15
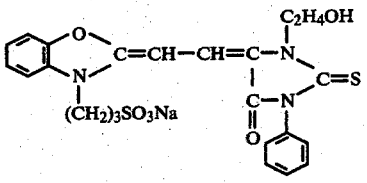
I-16
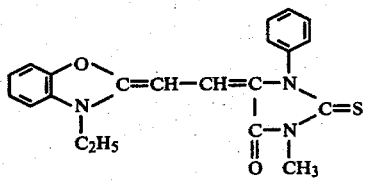
I-17
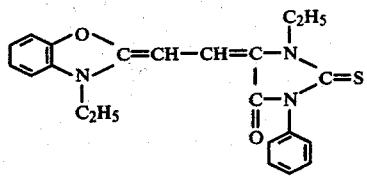
I-18
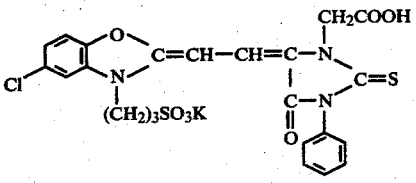
I-19
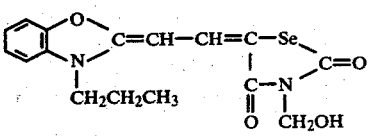
I-20
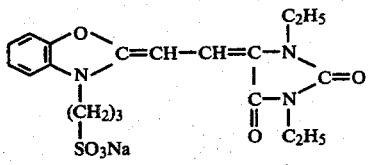
I-21
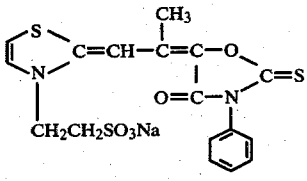
I-22
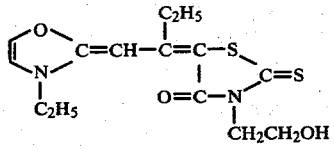

-continued
I-23
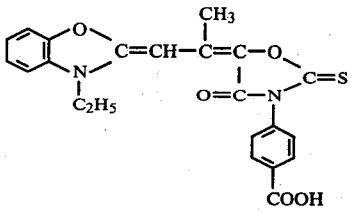
I-24
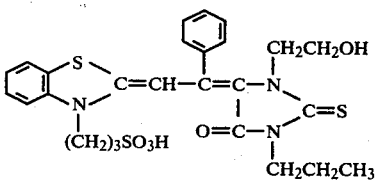
I-25
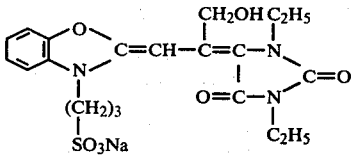
I-26
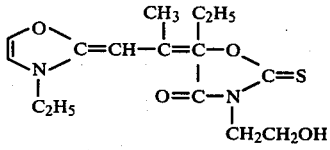
The representative compounds having the general formula (II), (IV) or (V) are as follows:
II-1
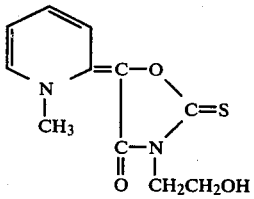
II-2
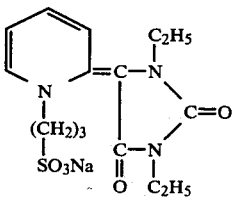
II-3
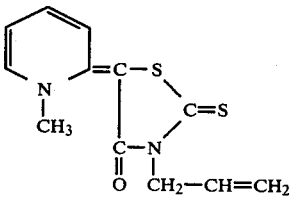
II-4
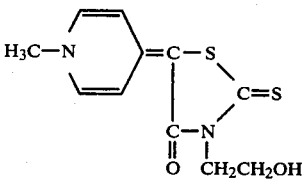
-continued
II-5
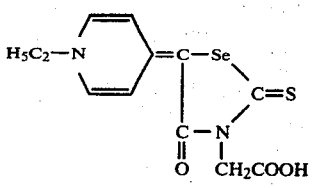
II-6
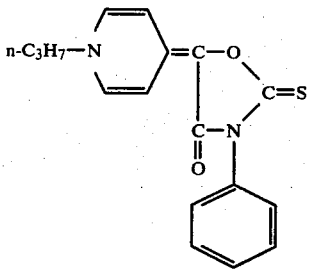
II-7
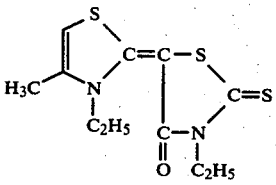
II-8
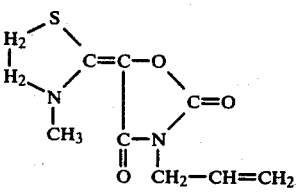
II-9
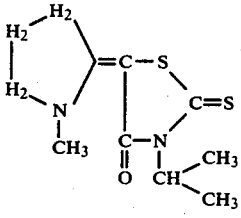
II-10
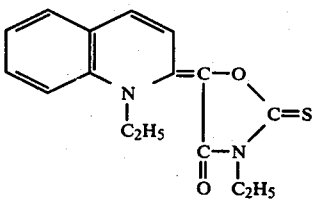
II-11
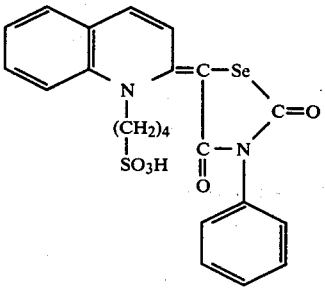

-continued

II-12

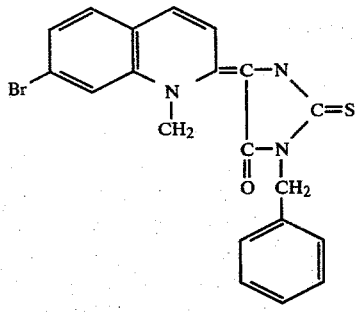

II-13

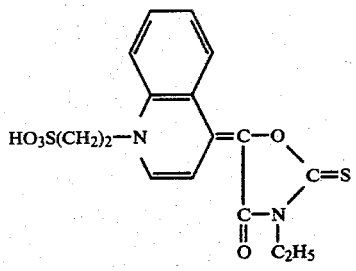

II-14

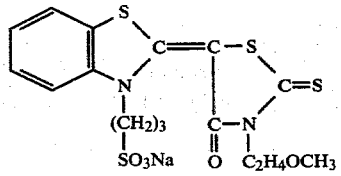

The sensitizing dyes according to this invention are preferably incorporated in an amount of 5–500 mg per mole of the silver halide, but are satisfactorily employable in an amount of 5–200 mg in order to control developability without any necessity of a sensitizing effect.

The sensitizing dyes according to this invention may be incorporated into the silver halide emulsion by admixing with a hydrophilic colloidal solution, for example, a gelatin solution in the water-miscible form thereof and it is also feasible, unless the effect of this invention is prevented, to dissolve them in methanol or ethanol or employ a variety of surfactants together with them.

Incorporation into a silver halide emulsion may be conducted at any time when chemical ripening is started or during the chemical ripening, but the incorporation should be done as early as possible after completion of the chemical ripening of the silver halide emulsion to accomplish a sufficient adsorption into silver halide grains, if a satisfactory sensitizing effect is desired.

In the silver halide emulsion to which a combination of the sensitizing dyes of this invention is applied, there can be also attained an optical sensitizing effect as explained hereinabove and described in Japanese Patent Publication No. 38408/1973.

The photographic material according to this invention does also show unexpected effects such as a highly improved effect on a tone reproducibility of a dot image by the action to exert a great influence upon behaviors of a developing agent and an oxidized product therefrom at the time of development, an additional effect to induce no fatigue of the developing solution employed and so on.

More specifically, a dot image has a different developability between a shadow dot part and a highlight part and, accordingly, if development time for a photographic material is determined depending upon the optimum development time at the shadow dot part, there remain wide fringes around dots in the highlight part, which results frequently in inconvenience upon plate-making.

On the contrary, where a combination of the sensitizing dyes according to this invention is applied, there can be attained an even developability between the shadow dot part and the highlight dot part and thus the above-depicted inconvenience is avoided.

In a prior system of a lith type photographic material with a lith type developing solution should be adopted respective different replenished amounts of various photographic materials employed and it was, therefore, very difficult to employ various kinds of photographic materials simultaneously, whereas the photographic material according to this invention has the great merit in that the same efficiency as a fresh developing solution can be obtained in the processed and fatigued developing solution upon a combined used of various kinds of photographic materials. It is to be noted that the above-explained superior effects can be unexpectedly accomplished according to the specific combination of the sensitizing dyes of this invention.

Moreover, the photographic material according to this invention maintains stable developing characteristics of the developing solution even if various additives from the silver halide emulsion flow into the developing solution and, accordingly, additives for a protective layer, a silver halide emulsion layer, an intermediate layer, an undercoated layer, a backing layer and the like may be widely investigated upon the design of the photographic material, which leads to a use of inexpensive and easily available substances and contributes greatly to reduction in a production cost.

On the other hand, one of the essential features of this invention is to use a strong oxidizing agent, i.e., the salt of tetrazolium, but the sensitizing dyes according to this invention do hardly undergo any decomposition or deterioration by such oxidizing agent.

Among the sensitizing dyes according to this invention, a combination of the compound having the general formula (III) with the compound having the general formula (IV) or (V) can particularly accomplish a remarkable improvement in fog, sensitivity and the like with lapse of time.

The photographic material according to this invention may include other sensitizing dyes than the present dyes, provided that they do not prevent the effect of the present invention. As the example of other known sensitizing dyes which may be utilized in addition to the present sensitizing dyes, there may be mentioned those as described in "The Cyanine Dye and Related Compound" by F. M. Harmer or "The Theory of Photographic Process" by E. K. Mees and T. H. James, 3rd Ed., 198–230. In addition, one may employ, together with the above-mentioned dyes, those carbocyanine type dyes as described in, for example, U.S. Pat. No. 3,867,146 and Japanese Patent Provisional Publication No. 33622/1976, if an optical sensitization to a longer wave length is desired.

The salt of tetrazolium which may be employed in this invention may include the salt having the undermentioned general formula (VI), (VII) or (VIII).

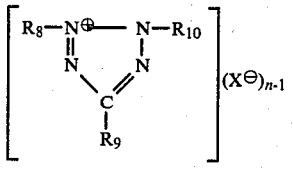

(VI)

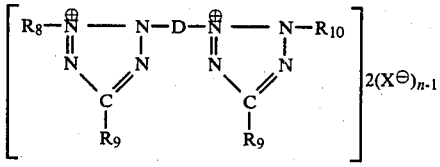

(VII)

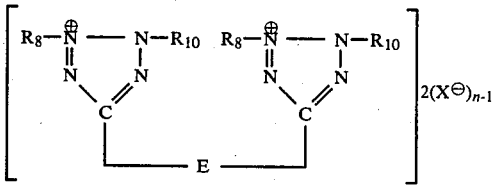

(VIII)

In the above formulae, $R_8$ and $R_{10}$ individually represent an alkyl group (e.g., methyl, ethyl and the like), an alkenyl group (e.g., allyl and the like), an aryl group (e.g., phenyl, tolyl, chlorophenyl, bromophenyl, iodophenyl, hydroxyphenyl, carboxyphenyl, aminophenyl, nitrophenyl, mercaptophenyl, α-naphthyl, β-naphthyl, hydroxynaphthyl, carboxynaphthyl, aminonaphthyl and the like) or a heterocyclic group (e.g., a thiazolyl group, a benzthiazolyl group, an oxazolyl group, a pyrimidinyl group, a pyridyl group and the like) and these groups may be a group capable of forming a metal chelate or complex; $R_9$ represents hydroxy, carboxyl or the salt thereof, an alkoxycarbonyl group (e.g., methoxycarbonyl, ethoxycarbonyl and the like), a group of $-SR_{11}$ [$R_{11}$ is a hydrogen atom, an alkyl group (e.g., methyl, ethyl and the like) or an aryl group (e.g., the aryl group as illustrated in $R_8$)], nitro, a hydrogen atom, an amino group (e.g., amino, ethylamino, phenylamino and the like), an alkyl group (e.g., methyl, ethyl, butyl, dodecyl, mercaptomethyl, mercaptoethyl and the like), an alkenyl group (e.g., allyl and the like) or an aryl group (e.g., the aryl group as illustrated in $R_8$); D represents a divalent aromatic group (for example a phenylene group, naphthylene group); E represents an alkylene group, an arylene group or an aralkylene group; $X^-$ represents an anion [e.g., a halide ion (e.g., chloride ion, bromide ion and the like), a perchlorate ion and the like]; and n is 1 or 2, provided that when the compound forms an intramolecular salt n is 1.

As preferable salts of tetrazolium for this invention, there may be mentioned the compounds of the general formula (VI) and the salts of 2,3,5-triphenyl-2H-tetrazolium are, in particular, more preferable as the salts of tetrazolium.

Where the salt of tetrazolium is used as non-diffusible in this invention, a non-diffusible salt can be synthesized for use by reacting a tetrazolium cation with an anion capable of making the selected compound non-diffusible.

As the anionic moiety for making the salts of tetrazolium non-diffusible, there may be mentioned the following;

- a higher alkylbenzenesulfonic acid anion such as p-dodecylbenzenesulfonic acid anion and the like,
- a higher alkyl sulfuric acid ester such as lauryl sulfate anion and the like,
- a dialkyl sulfosuccinate anion such as di-2-ethylhexylsulfosuccinate anion and the like,
- a polyether alcohol sulfuric acid ester anion such as cetyl polyethenoxy sulfate anion and the like,
- a higher aliphatic acid anion such as stearic acid anion and the like, and a polymer having an acid radical such as polyacrylic acid anion and the like.

The non-diffusible salts of tetrazolium according to this invention can be synthesized by an optional selection of the anionic and cationic moieties.

The following are typical examples of the salts of tetrazolium which may be used in this invention but not intended to limit the salts of tetrazolium compound employable in this invention.

(1) 2-(Benzothiazol-2-yl)-3-phenyl-5-dodecyl-2H-tetrazolium bromide
(2) 2,3-Diphenyl-5-(4-t-octyloxyphenyl)-2H-tetrazolium chloride
(3) 2,3,5-Triphenyl-2H-tetrazolium chloride
(4) 2,3,5-Tri(p-carboxyethylphenyl)-2H-tetrazolium chloride
(5) 2-(Benzothiazol-2-yl)-3-phenyl-5-(o-chlorophenyl)-2H-tetrazolium bromide
(6) 2,3-Diphenyl-2H-tetrazolium chloride
(7) 2,3-Diphenyl-5-methyl-2H-tetrazolium chloride
(8) 3-(p-Hydroxyphenyl)-5-methyl-2-phenyl-2H-tetrazolium bromide
(9) 2,3-Diphenyl-5-ethyl-2H-tetrazolium bromide
(10) 2,3-Diphenyl-5-n-hexyl-2H-tetrazolium bromide
(11) 5-Cyano-2,3-diphenyl-2H-tetrazolium bromide
(12) 2-(Benzothiazol-2-yl)-5-phenyl-3-(4-tolyl)-2H-tetrazolium bromide
(13) 2-(Benzothiazol-2-yl)-5-(4-chlorophenyl)-3-(4-nitrophenyl)-2H-tetrazolium chloride
(14) 5-Ethoxycarbonyl-2,3-di(3-nitrophenyl)-2H-tetrazolium chloride
(15) 5-Acetyl-2,3-di(p-ethoxyphenyl)-2H-tetrazolium bromide
(16) 2,5-Dephenyl-3-(p-tolyl)-2H-tetrazolium chloride
(17) 2,5-Diphenyl-3-(p-iodophenyl)-2H-tetrazolium chloride
(18) 2,3-Diphenyl-5-(p-diphenyl)-2H-tetrazolium chloride
(19) 5-(p-Bromophenyl)-2-phenyl-3-(2,4,6-trichlorophenyl)-2H-tetrazolium chloride
(20) 3-(p-Hydroxyphenyl)-5-(p-nitrophenyl)-2-phenyl-2H-tetrazolium chloride
(21) 5-(3,4-Dimethoxyphenyl)-3-(2-ethoxyphenyl)-2-(4-methoxyphenyl)-2H-tetrazolium chloride
(22) 5-(4-Cyanophenyl)-2,3-diphenyl-2H-tetrazolium chloride
(23) 3-(p-Acetamidophenyl)-2,5-diphenyl-2H-tetrazolium bromide
(24) 5-Acetyl-2,3-diphenyl-2H-tetrazolium bromide
(25) 5-(Fur-2-yl)-2,3-diphenyl-2H-tetrazolium chloride
(26) 5-(Thien-2-yl)-2,3-diphenyl-2H-tetrazolium chloride
(27) 2,3-Diphenyl-5-(pyrid-4-yl)-2H-tetrazolium chloride
(28) 2,3-Diphenyl-5-(quinol-2-yl)-2H-tetrazolium bromide
(29) 2,3-Diphenyl-5-(benzoxazol-2-yl)-2H-tetrazolium bromide
(30) 2,3-Diphenyl-5-nitro-2H-tetrazolium bromide

(31) 2,2',3,3'-Tetraphenyl-5,5'-1,4-butylene-di-(2H-tetrazolium) bromide
(32) 2,2',3,3'-Tetraphenyl-5,5'-p-phenylene-di-(2H-tetrazolium) bromide
(33) 2-(4,5-Dimethylthiazol-2-yl)-3,5-diphenyl-2H-tetrazolium bromide
(34) 3,5-Diphenyl-2-(triazin-2-yl)-2H-tetrazolium chloride
(35) 2-(Benzothiazol-2-yl)-3-(4-methoxyphenyl)-5-phenyl-2H-tetrazolium bromide
(36) 2-p-Iodophenyl-3-p-nitrophenyl-5-phenyl-2H-tetrazolium chloride
(37) 2,3,5-Triphenyl-2H-tetrazolium di-2-ethylhexyl-sulfosuccinate
(38) 2,3,5-Tri(p-carboxyethylphenyl)-2H-tetrazolium p-octadecylbenzenesulfonate
(39) 2-(Benzothiazol-2-yl)-3-phenyl-5-(o-chlorophenyl)-2H-Tetrazolium di-2-ethylhexylsulfosuccinate
(40) 2,3-Diphenyl-2H-tetrazolium polyethenoxysulfate
(41) 2,3-Diphenyl-5-methyl-2H-tetrazolium ethyl-polyethenoxysulfate
(42) 3-(p-Hydroxyphenyl)-5-methyl-2-phenyl-2H-tetrazolium di-isopropylnaphthalenesulfonate
(43) 2,3-Diphenyl-5-ethyl-2H-tetrazolium di-2-ethylhexylsulfosuccinate
(44) 2,3-Diphenyl-5-n-hexyl-2H-tetrazolium di-2-ethylhexylsulfosuccinate
(45) 5-Cyano-2,3-diphenyl-2H-tetrazolium polyethenoxysulfate
(46) 2-(Benzothiazol-2-yl)-5-phenyl-3-(4-tolyl)-2H-tetrazolium di-2-ethylhexylsulfosuccinate
(47) 2-(Benzothiazol-2-yl)-5-(4-chlorophenyl)-3-(4-nitrophenyl)-2H-tetrazolium di-isopropylnaphthalenesulfonate
(48) 5-Ethoxycarbonyl-2,3-di-(p-nitrophenyl)-2H-tetrazolium ethylpolyethenoxysulfate ethylpolyethenoxysulfate
(49) 5-Acetyl-2,3-di(3-nitrophenyl)-2H-tetrazolium di-2-ethylhexylsulfosuccinate
(50) 2,5-Diphenyl-3-(p-tolyl)-2H-tetrazolium p-dodecylbenzenesulfonate
(51) 2,5-Diphenyl-3-(p-iodophenyl)-2H-tetrazolium p-octylbenzenesulfonate
(52) 5-(p-Bromophenyl)-2-phenyl-3-(2,4,6-trichlorophenyl)-2H-tetrazolium di-2-ethylhexylsulfosuccinate
(53) 5-(3,4-Dimethoxyphenyl)-3-(2-ethoxyphenyl)-2-(4-methoxyphenyl-2H-tetrazolium p-dodecylbenzenesulfonate
(54) 5-(4-cyanophenyl)-2,3-diphenyl-2H-tetrazolium di-2-ethyl-decylsulfonate
(55) 3-(p-Acetamidophenyl)-2,5-diphenyl-2H-tetrazolium di-2-ethylhexylsulfosuccinate
(56) 5-Acetyl-2,3-diphenyl-2H-tetrazolium di-isopropylnaphthalenesulfonate
(57) 5-(Fur-2-yl)-2,3-diphenyl-2H-tetrazolium p-dodecylbenzenesulfonate
(58) 5-(Thien-2-yl)-2,3-diphenyl-2H-tetrazolium di-2-ethylhexylsulfosuccinate
(59) 2,3-Diphenyl-5-(pyrid-4-yl)-2H-tetrazolium p-dodecylbenzenesulfonate
(60) 2,3-Diphenyl-5-(quinol-2-yl)-2H-tetrazolium stearate The salt thus synthesized, for example, 2,3,5-triphenyl-2H-tetrazolium dioctyl-succinate-sulfonate may be dispersed into a gelatin solution or a gelatin matrix by mixing respective soluble tetrazolium and the anion salt with an aqueous gelatin solution and then by mixing them as specifically mentioned in working Examples set forth below. Alternatively, an organic molecule may be separately synthesized from the tetrazolium salt and a pair ion, dissolved in a suitable solvent (e.g., a low-boiling solvent such as methanol, ethyl acetate, acetone or dimethyl sulfoxide and/or a high-boiling solvent such as dioctyl phthalate, dibutyl phthalate, tricresyl phosphate, triphenyl phosphate, diethyl laurylamide or dibutyl laurylamide) and then dispersed in the gelatin solution.

It is believed that the salt of tetrazolium dispersed in the gelatin solution can produce a more active developing agent by a local and one-stage oxidation of a developing agent and also prevent the active agent's removal by the reaction with a high concentration of the sulfite ion present thereabout. Therefore, dispersion of the salts of tetrazolium is a significant factor and an average grain size of not more than 1.0$\mu$ in a non-diffusible state, when examined according to the method mentioned below, is extremely preferable.

Since crystallinity is variable depending upon the individual salt of tetrazolium, an average grain size of the salt of tetrazolium will be discussed by measurement of a diameter of an oil drop, for example, in case of oily 2,3,5-triphenyl-2H-tetrazolium diethylhexylsuccinate or of a length of a crystal, for example, in case of 2,3-diphenyl-5-naphtho-2H-tetrazolium di-t-butyl-naphtylsulfonate as needles. If the average grain size is larger beyond the above-defined value, an improved effect on a dot or a high contrast is poor together with occurrence of fine hindered blackening, which does not lead to production of a dot image with a high quality.

The diffusible salt of tetrazolium is dispersed into the gelatin solution in a molecular state and thus hardly offers the above-mentioned disadvantages, but a favourable result is attainable by paying careful attention to agitation, dispersion and maintenance of the temperature of the gelatin mixture.

The salts of tetrazolium employed in this invention may be applied alone to give satisfactory qualities, but a combination thereof may be utilized.

For instance, as an example of a single use, there may be mentioned the compound derived from 2,3,5-triphenyl-2H-tetrazolium chloride and sodium diisopropylnaphthalenedisulfonate or the compound derived from 2-p-iodophenyl-3-p-nitrophenyl-5-phenyl-2H-tetrazolium chloride or 2,5-diphenyl-3-(p-iodophenyl)-2H-tetrazolium chloride and sodium diethylhexyl-succinatesulfonate as preferable non-diffusible salts of tetrazolium.

Also, as an example of a combination use, there may be mentioned, as a combination of preferable diffusible salts of tetrazolium, 2,3,5-triphenyl-2H-tetrazolium chloride and 2,5-diphenyl-3-(p-iodophenyl)-2H-tetrazolium chloride and, as a combination of non-diffusible salts of tetrazolium, the salt derived from 2,3,5-triphenyl-2H-tetrazolium chloride and sodium diisopropylnaphthalenedisulfonate and the salt derived from 2-p-iodophenyl-3-p-nitrophenyl-5-phenyl-2H-tetrazolium chloride or 2,5-diphenyl-3-(p-iodophenyl)-2H-tetrazolium chloride and sodium diethylhexyl-succinatesulfonate.

According to a preferred embodiment of the invention, the salts of tetrazolium of this invention is incorporated into a silver halide emulsion layer.

According to another preferred embodiment of this invention, the salt is incorporated in a hydrophilic colloidal layer adjacent directly to the hydrophilic colloidal layer containing the silver halide emulsion or in an adjacent hydrophilic colloidal layer through an intermediate layer.

According to another embodiment of this invention, the salt of tetrazolium of this invention is dissolved in a suitable organic solvent and then may be incorporated into a photographic material by a direct coating over the most outer layer of the said material or the part forming a most outer layer where a hydrophilic colloidal layer is coated, through an overcoating method and the like.

The salt of tetrazolium of this invention is generally employed in an amount of about 0.0001 mole up to 10 moles, preferably 0.001 mole up to 1 mole, per mole of the silver halide contained in the photographic material of this invention.

The term "non-diffusible salt of tetrazolium" as used herein means a salt which does not dissolve from the photosensitive material to the developing solution during the development. In other words, the compound does not dissolve in a concentration of several %, preferably not more than 2%, when a gelatin layer containing the salt is dipped for 10 minutes in an aqueous developing solution at 30° C. described below.

| | |
|---|---|
| Metol | 3.5 g |
| Sodium sulfite | 60 g |
| Hydroquinone | 9 g |
| $Na_2CO_3H_2O$ | 54 g |
| KBr | 2.5 g |
| 5-Nitrobenzimidazol | 0.5 g |
| 1-Phenyl-5-mercaptotetrazole | 10 mg |
| Water | to make 1l |

The demerit of the method which gives the dissolved tetrazolium compound is described in the patent specification BE-844808.

According to the results confirmed by the present inventors, the non-diffusible salt of tetrazolium exerts the most superior properties for a super high contrast image, inter alia, for a dot image, while the diffusible salt of tetrazolium is suited for a super high contrast image, generally speaking, with a somewhat lower $\gamma$ than that of the non-diffusible salt of tetrazolium and exerts superior properties for line drawing, reproduction, copying, contact, facsimile and the like.

All salts of tetrazolium within the scope of the above general formulae (VI), (VII) and (VIII) may be advantageously employed in this invention, but the compounds of the general formula (VI) are preferable and those wherein $R_8$, $R_9$ and $R_{10}$ individually are a phenyl group, as explained hereinabove.

The salts show a relatively strong high contrast effect, though they are diffusible, and are made much more high contrasting by non-diffusion and thus produce a fringe (a lower density part) around a dot of not more than 0.2$\mu$ when observed with a magnifying lens of 100–200 magnifications and can be printed as such upon a printing plate without any need for reduction, adherence and so on. Additionally, the above salts of tetrazolium do in no way produce a color staining and then are applicable to a wide variety of photographic materials.

As the silver halide employed for the photographic material of the invention, there can be included silver halide used for the conventional photographic materials, e.g. silver bromide, silver chlorobromide, silver iodobromide, silver chloroiodobromide, silver chloride or a mixture thereof and they may be desirably employed to produce a silver image with a $\gamma$ of not less than 10. In order to produce a dot image with a higher quality, a silver halide containing above 50 mole % of silver chloride is particularly used for favourable results. The crystal form of a silver halide employable herein includes a cube mainly with (100) planes, an octahedron mainly with (111) planes, various fixed or amorphous forms wherein both (100) and (111) planes are present or a twin.

For a lith type silver halide emulsion should have been heretofore employed such a silver halide that contains above 50 mole % of silver chloride and has a relatively uniform gain distribution and predominantly (100) planes, whereas the photographic materials of this invention do not have such particular restrictions, but may include any silver halides optionally. This may provide a wide range of selectivities for the manufacture thereof and thus lead to an increased facility of manufacture. Furthermore, various sorts of photographic materials may be prepared from a common silver halide, changes in composition of a fatigued developing solution (largely depending upn a halide ion) after development may be readily monitored and then a control of a developer activity can be easily made by a user.

The method for preparing a silver halide in this invention may be any of the publicly known methods, for example, those commonly referred to as a single jet method, a double jet method, a positive mixing method, a back mixing method, a simultaneous mixing method, an acidification method, a neutralization method, an ammonical method; a method wherein an addition rate is continuously or stepwise changed; a method comprising any optional combination of the above-recited methods; a method wherein mixing is discontinued, a physical ripening is effected and mixing is continued; a method of physical ripening with detection of specific physico-chemical factors as described in West German Pat. No. 2,539,507; a method wherein a mixing tank and a physical ripening tank are separately equipped as discribed in Japanese Patent Provisional Publication No. 60526/1974; a method for preparing an emulsion to be for Clayden's effect as described in U.S. Pat. No. 2,756,148; a method for preparing the so-called conversion type emulsion as described in British Pat. No. 635,841 and U.S. Pat. No. 3,622,318; and the like.

The crystalline grain of such a silver halide may include any atoms of iridium, rhodium, osmium, cobalt, bismuth, cadmium and the like. The silver halide may be of a surface latent image type or an internal latent image type and also prepared by mixing various silver halide produced according to several methods.

Preferable silver halide which may be employed for the photographic material of this invention has an average grain size of 0.05 to 1.5 $\mu$m and contains at least 60% of the whole grain numbers of silver halide grains having a 0.6 to 1.4 times larger grain size of the above-defined average grain size. The most preferable silver halide comprises silver chloroiodobromide or silver chlorobromide grains having an average grain size of 0.1 to 0.5 $\mu$m, 0.6 to 1.4 times larger grain size of the above-defined average grain size in at least 60% of the whole grain numbers thereof and a cube mainly with (100) planes and may provide a $\gamma$ of not less than 12.

The silver halide emulsion of the invention may be sensitized with various kinds of chemical sensitizers. As the sensitizer, there can be mentioned, for example, activated gelatin, sulfur sensitizers (e.g. sodium thiosulfate, aryl thiocarbamide, thiourea or aryl isocyanate, etc.), selenium sensitizers (e.g. N,N-dimethylserenourea or selenourea, etc.), reducing sensitizers (e.g. triethylenetetramine or stannic chloride, etc.) and various noble metal sensitizers represented by potassium chloroaurite, potassium auriothiocyanate, potassium chloroaurate, 2-aurosulfobenzothiazole methylchloride, ammonium chloropalladate, potassium chloroplatinate and sodium chloropalladite. The sensitizer may be employed alone, or mixed together. Ammonium thiocyanate may be auxiliarily employed when a gold sensitizer is employed.

The silver halide emulsion which may be employed in this invention may be stabilized with the compounds described, for example, in U.S. Pat. Nos. 2,444,607, 2,716,062 and 3,512,982; West German Patent Publication Nos. 2,189,380, 2,058,626 and 2,118,411; Japanese Patent Publication No. 4133/1968; U.S. Pat. No. 3,342,596; Japanese Patent Publication No. 4417/1972; West German Patent Publication No. 2,149,789; and Japanese Patent Publications Nos. 2825/1964 and 13566/1974; preferably, for example, 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo-(1,5-a)pyrimidine, 7-hydroxy-s-triazolo(1,5-a)pyrimidine, 5-methyl-6-bromo-7-hydroxy-s-triazolo(1,5-a)pyrimidine, esters or salts of gallic acid (e.g. isoamyl gallate, dodecyl gallate, propyl gallate or sodium gallate), mercaptans (e.g. 1-phenyl-5-mercaptotetrazole or 2-mercaptobenzothiazole), benzotriazoles (e.g. 5-bromobenzotriazole or 4-methylbenzotriazole) and benzimidazoles (e.g. 6-nitrobenzimidazole). Furthermore, the silver halide emulsion of this invention may contain a latent image stabilizer such as a sulfur-containing amino acid and the like or a gradation-adjusting agent such as cadmium or rhodium salt and the like as described in, e.g., West German Patent Publications 2,217,895 and 2,217,153.

It has been known in, e.g. British Pat. No. 775,197 and U.S. Pat. No. 3,488,709, to employ a rhodium or cadmium salt to increase the contrast of silver halide emulsion. However, problems still remain when the rhodium salt is employed. For example, the use of rhodium salt tends to cause an unevenness of the product due to the minute amount of addition and the narrow allowable range thereof of the salt, and thus makes it difficult to produce stable photographic material. In case of the cadmium salt, it has to be added as little as possible from an ecological viewpoint, for it is washed out by film-processing and comes finally into the environment. The cadmium salts are known to prevent the metabolism and to be harmful to living tissues. Cadmium may be detected not only in air but also in the body of sea animals. As a result of interest in public health and in the maintenance of normal ecological balance in view of the toxicity of rare metals, including cadmium mentioned above, the inventors have developed a novel method to obtain a light-sensitive material with sufficiently high contrast, even without use of such harmful metals.

The above-mentioned silver halide and tetrazolium compound are incorporated into a hydrophilic colloidal layer.

The hydrophilic colloid advantageously employed in the invention is gelatin. As other hydrophilic colloids than gelatin, are mentioned, e.g. colloidal albumin, agar, gum arabic, arginic acid, hydrolyzed cellulose acetate, acrylamide, imidated polyamide, polyvinyl alcohol, hydrolized polyvinyl acetate, water-soluble polymer described in, e.g. British Pat. No. 523,661, West German Patent Publications 2,255,711 and 2,046,682 and U.S. Pat. No. 3,341,332, gelatin derivatives such as phenylcarbamyl-, acylated- or phthalated- gelatin described in, e.g. U.S. Pat. Nos. 2,614,928 and 2,525,753, or graft-polymerized monomers on gelatin having the ethylene group and being capable of polymerization, such as acrylic acid and the ester thereof, styrene, a methacrylic acid and the ester thereof, described in, e.g. U.S. Pat. Nos. 2,548,520 and 2,831,767. Such hydrophilic colloids may also be applied to a layer containing no silver halide, e.g. an antihalation layer, a protective layer or a intermediate layer.

The photographic material of the invention may be prepared by coating the above-mentioned layer containing the silver halide, the sensitizing dye and the salts of compound of the invention on a suitable photographic support. As the representative supports employed in the invention are mentioned, e.g. a baryta paper, a polyethylene-coated paper, a synthetic polypropylene paper, a glass plate, a cellulose acetate or cellulose nitrate film, a polyester film such as a polyethylene terephthalate film, a polyamide film, a polypropylene film, a polycarbonate film, a polystyrene film and the like. The supports are optionally selected depending on the purpose for which the photographic material is used.

As mentioned above, the photographic material of the invention comprise at least one hydrophilic colloidal layer, coated on a support, containing a silver halide of the invention and a sensitizing dye and a salt of tetrazolium.

It is preferable in the photographic material of the invention that a protective layer having a suitable thickness s coated. The protective layer is advantageously a gelatin layer, the thickness of which is preferably 0.1–10 μm, more preferably 0.8–2.0 μm.

Various kinds of photographic additives may optionally be added to the above-mentioned hydrophilic colloid of the invention, as far as they do not impair the effect of the invention. As the additives, there can be used, e.g. a gelatin plasticizer, a hardening agent, a surface active agent, an image stabilizer, an ultraviolet absorber, an antistaining agent, a pH adjuster, an antioxidant, an antistatic agent, a viscosity-increasing agent, a granularity improving agent, a dye, a mordant, a brightening agent, a development regulator, a matting agent, and the like.

Among the additives mentioned above, the following may particularly and preferably be employed: viscosity-increasing agents and plasticizers, described in U.S. Pat. Nos. 2,960,404 and 3,767,410, West German Patent Publication No. 1,904,604, Japanese Patent Publications Nos. 4939/1968 and 15462/1970 and Provisional Publication No. 63715/1973, Belgian Pat. Nos. 762,833 and 558,143, e.g. a styrene/sodium maleate copolymer and dextran sulfate, etc.; hardening agents of an aldehyde, epoxy, ethyleneimine, active halogen, vinylsulfone, isocyanate, sulfonic acid ester, carbodiimide, mucochloric acid or acryloyls, etc.; image stabilizers, e.g. 6,6'-butylidene-bis(2-t-butyl-4-methylphenol) and 4,4'-methylene-bis(2,6-di-t-butylphenol), etc.; ultraviolet absorbers, described in, e.g. U.S. Pat. No. 3,253,921, British Pat. No. 1,309,349, Japanese Patent Publications 736/1973, 5496/1973, 41572/1973, 30492/1973, 31255/1973, particularly 2-(2'-hydroxy-5-t-butylphenyl)benzotriazole, 2-(2'-hydroxy-3,5-di-t-butylphenyl)benzotriazole-2-(2'-hydroxy-3'-t-butyl-5'-butylphenyl)-5-chlorobenzotriazole and 2-(2'-hydroxy-3',5'-di-t-butylphenyl)-5-chlorobenzotriazole; surface active agents for coating aids, emulsifiers, infiltration-improving agents for processing solution, defoamers, or agents for controlling various physical properties of the light-sensitive material, described in, British Pat. Nos. 548,532 and 1,216,389, U.S. Pat. Nos. 3,026,202 and 3,514,293, Japanese Patent Publications Nos. 26580/1969, 17922/1968, 17926/1968, 13,166/1968 and 20785/1973, French Pat. No. 202,588, Belgian Pat. No. 773,459 and Japanese Patent Provisional Publication No. 101118/1973, including anionic, cationic nonionic and amphoteric compounds; mordants described in, e.g. U.S. Pat. Nos. 2,113,381 and 2,548,564; antistaining agents described in, e.g. U.S. Pat. Nos. 2,360,210, 2,728,659 2,732,300 and 3,700,453, particularly 2-methyl-5-hexadecylhydroquinone, 2-methyl-5-secoctadecylhydroquinone and 2,5-di-t-octylhydroquinone, etc.; antistatic agents described in, e.g. U.S. Pat. Nos. 2,882,157 and 2,972,535, Japanese Patent Publications Nos. 24159/1971, 39312/1971, 43809/1973, 4833/1974, 64/1974, 8742/1972 and Japanese Patent Provisional Publications Nos. 89979/1973, 20785/1973, 43130/1973, 90391/1973, 33627/1972; matting agents described in, e.g. U.S. Patent Nos. 2,992,101 and 2,956,884, British Pat. No. 1,221,980 and British Pat. No. 1,307,373, particularly silica gel having a grain size of 0.5–20 μm and polymethylmethacrylate having a grain size of 0.5–20 μm, developing promotors, e.g. benzyl alcohol and a polyoxyethylene series compound, e.g. the compounds described in the Journal of the Photographic Science, 1954, 12, 5, "On the effect of polyethyleneoxides on hydroquinone development" by N. W. Wood.

Also, the alkylene oxide polymer, which may be employed in the light-sensitive silver halide photographic material of this invention or in the solution for the treatment of the said light-sensitive silver halide photographic material, may be a condensed product of an alkylene oxide with a glycol of 8–18 carbon atoms as described in U.S. Pat. No. 2,240.472 and British Pat. No. 443,559; a condensed product of an alkylene oxide with an aliphatic alcohol, a condensed product of an alkylene oxide with an aliphatic acid such as lauric acid, glycine and the like, a condensed product of an alkylene oxide with an aliphatic acid amide or an aliphatic amine such as glycine, laurylamide and the like, a condensed product of an alkylene oxide with a phenol as described in U.S. Pat. No. 1,970,578; a dehydrated product of an alkylene oxide with hextol as described in U.S. Pat. No. 2,400,532.

Furthermore, there may be employed those compounds as described in West German Pat. No. 1,122,834, British Pat. No. 805,826, Japanese Patent Publications 6475/1956, 10245/1968, 13822/1968 and 18009/1972.

As one embodiment in this invention, there may be particularly a preferable group of the following polyethylene oxides or polypropylene oxides.

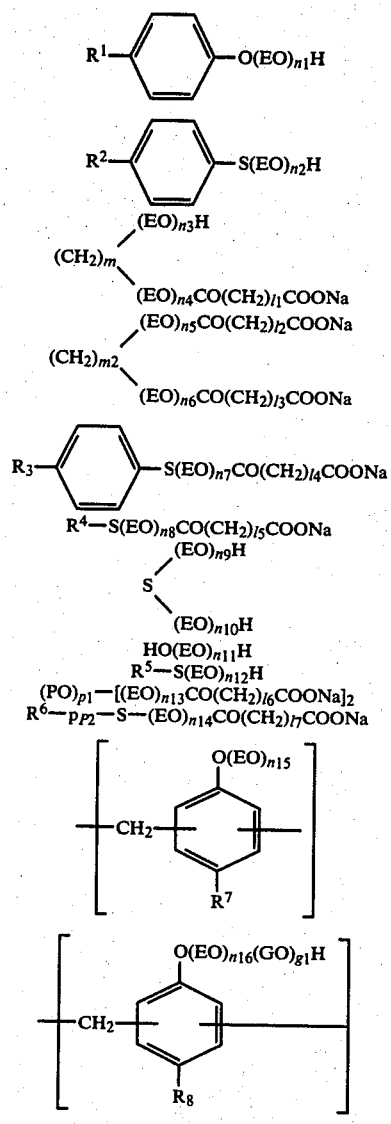

In the above formulae, $R^1$, $R^2$, $R^3$, $R^4$, $R^5$, $R^6$, $R^7$ and $R^8$ individually represent an alkyl group of not more than 10 carbon atoms which may be substituted with a hydroxy group. EO represents an ethyleneoxide chain, PO represents a propyleneoxide chain and GO represents a glycidol chain. $n_1$, $n_2$, $n_3$, $n_4$, $n_5$, $n_6$, $n_7$, $n_8$, $n_9$, $n_{10}$, $n_{11}$, $n_{12}$, $n_{13}$, $n_{14}$, $n_{15}$ and $n_{16}$ may be within a range of 6–150. $m_1$ and $m_2$ represent 1–4. $l_1$, $l_2$, $l_3$, $l_4$, $l_5$, $l_6$ and $l_7$ represent 1–3. $p_1$ and $p_2$ represent 2–30. $g_1$ represents 1–10.

Where the above-mentioned polyalkylene oxide series compound is employed in the present photographic material or in a developer for treating the said photographic material, as initial developability of the present photographic material can be increased and an optimum development period can be greatly reduced, which can highly contribute to improvement in workability of users. Additionally, the photographic material containing the above-recited compound can completely prevent changes in photographic properties with time, especially deterioration of gamma and dot quality with time.

The main developing agent, which may be employed in this invention, has no particular structural, physical and chemical limitations. More specifically, the said agent may include any organic or inorganic developing agents and developing additives or a combination thereof as described in "The Theory of the Photographic Process", 3rd Ed., Pages 278–381 (1966) by E. K. Mees and T. H. James. Preferable are ferrous oxalate; hydroxylamine; N-hydroxymorpholine; hydroquinones, e.g., hydroquinone, hydroquinone monosulfonate, chlorohydroquinone, t-butylhydroquinone; pyrazolidones, e.g., catechol, resorcin, pyrogallol, amidol, phenidone; p-aminophenols, e.g., p-aminophenol, glycine, Metol; p-phenylenediamines, e.g., p-phenylenediamine, 4-amino-N-ethyl-N-ethoxyaniline; ascorbic acid and the like. More preferable are Metol alone and a combination of phenidone with Metol, Metol with hydroquinone, phenidone with Metol and t-butylhydroquinone, phenidone with ascorbic acid or phenidone with p-aminophenol, but similar favorable results are obtainable with other various combinations.

The developing solution which may be employed in this invention may include the above-mentioned developing agent and a preservative such as a sulfite salt, hydroxylamine and optionally an agent for pH adjustment and buffering commonly employed in a black and white developer such as a caustic alkali, an alkali carbonate, an alkali borate, an amine and an inorganic development retarder such as potassium bromide, an organic development retarder such as benzotriazole and nitroindazole as described in British Pat. No. 1,376,600, a sequestering agent (a water softener) such as ethylenediamine tetraacetic acid, a hardener such as formalin, glyoxal, glutaraldehyde, a surfactant such as sodium dodecylbenzenesulfonate, a developing promotor such as polyethylene glycol oleate, or a photographic coupler such as an open-chained keto-methylene type yellow coupler, a 5-pyrazolone type magenta coupler, a phenol or $\alpha$-naphthol type cyanogen and the like.

In particular, the photographic material of this invention has stable photographic properties such as sensitivity, dot quality and the like upon the amount of potassium bromide in a developing solution and hence characteristics of being processed with an extremely better reproducibility than of prior light-sensitive silver halide photographic materials in a continuous process through automatic processor and the like.

Furthermore, addition of a contrast agent often used for the conventional high contrast developing solution to the developing solution employed in the invention gives no undesirable influence on the photographic quality.

The temperature, at which the photographic material is processed, is 15°–80° C., preferably 20°–55° C., and the time required for process is of 5 seconds to 5 minutes, preferably 10 seconds to 2 minutes.

The image produced according to this invention is a high contrast silver image which is more easily handled than prior lith type developing system and then applicable to a wide variety of fields. More specifically, there may be mentioned various photographic materials for printing (suitable for line- and dot-images), copying, reproducing, micro photographic materials, computerized typesetting and the like.

The invention is further concretely explained by the following Examples, which by no means restrict the scope of the invention and various many modified embodiments may be possible:

EXAMPLE 1

To 200 ml of 4% inert gelatin at 55° C. were poured the Solutions I and II having the following compositions, while maintained at 60° C., simultaneously over 2 minutes.

| | |
|---|---|
| Solution I: | |
| Potassium bromide | 11g |
| Sodium chloride | 18g |
| Potassium iodide | 0.1g |
| Gelatin | 3g |
| Water | q.s. to make up 300ml |
| Solution II: | |
| Silver nitrate | 60g |
| Water | q.s. to make up 200ml |

After admixing, the mixture was maintained at 60° C. for 4 minutes and then physical ripening was accomplished. Excess salts were removed by decantation. The emulsion was chemically ripened by the use of gold sensitizers and sulfur sensitizers and 250 mg of 4-hydroxy-6-methyl-1,3,3a,7-tetrazaindene, 150 mg of spirobis (3,3-dimethyl-5,6-dihydroxyindane) and 100 mg of the aforesaid polyethylene oxide compound c) ($n_3=30$, $n_4=30$, $m_1=4$, $l_1=2$) were added thereto. After thorough agitation, the emulsion was again heated and maintained at 50° C. Thereafter, $5\times10^{-3}$ mole of the salt of tetrazolium shown in Table 1 (each $2.5\times10^{-3}$ mole portion of two salts of tetrazolium when employed together) and $2\times10^{-4}$ mole of the sensitizing dyes of this invention when employed alone or each $1\times10^{-4}$ mole portion of two of them when employed together were added thereto.

Then, the resulting emulsion was coated upon a polyethylene terephthalate support so as to contain 50 mg of silver/100 cm$^2$ and then a gelatin layer was coated thereupon so as to contain 15 mg of gelatin/100 cm$^2$. These films were exposed through a contact screen and a wedge and processed by means of an automatic processor equipped with a roller-convey system.

| | | |
|---|---|---|
| Development | 30° C. | 45 seconds |
| Fixing | 25° C. | 35 seconds |
| Water washing | 15° C. | 35 seconds |
| Drying | 45° C. | 20 seconds |

The developer had the following composition.

| | |
|---|---|
| Phenidone | 0.4g |
| Methol | 5g |
| Hydroquinone | 1g |
| Anhydrous sodium sulfite | 60g |
| Sodium carbonate monohydrate | 54g |
| 5-Nitroindazole | 100mg |
| Potassium bromide | 2.5g |
| Water | q.s. to make up 1l (pH 10.20) |

TABLE 1

| Sample No. | Salt of tetrazolium | Anion | Sensitizing dye | | Relative sensitivity | Dot* quality | Development lag (sec.)** | Rate of replenished amount of developer*** |
|---|---|---|---|---|---|---|---|---|
| 1 | (1) | — | — | — | 100 | 3.0 | 35 | 100 |
| 2 | (1) | — | I-15 | — | 160 | 4.0 | 20 | 80 |
| 3 | (1) | — | — | II-4 | 140 | 4.0 | 25 | 75 |
| 4 | (1) | — | I-15 | II-4 | 190 | 4.5 | 10 | 60 |
| 5 | (1) | DES | I-15 | II-4 | 200 | 4.5 | 10 | 60 |
| 6 | (3) | — | — | — | 105 | 3.5 | 30 | 95 |
| 7 | (3) | — | I-15 | — | 160 | 4.0 | 20 | 80 |
| 8 | (3) | — | — | II-3 | 135 | 4.0 | 15 | 75 |
| 9 | (3) | — | I-15 | II-3 | 220 | 4.5 | 5 | 55 |
| 10 | (3) | DES | I-15 | II-3 | 250 | 5.0 | 0 | 50 |
| 11 | (6) | — | I-5 | II-2 | 185 | 4.0 | 10 | 60 |
| 12 | (11) | DIPN | I-7 | II-10 | 185 | 4.0 | 5 | 65 |
| 13 | (15) | — | I-10 | II-12 | 190 | 4.5 | 10 | 60 |
| 14 | (16) | DES | I-13 | II-14 | 210 | 5.0 | 5 | 55 |
| 15 | (17) | — | I-14 | II-5 | 205 | 4.5 | 5 | 55 |
| 16 | (32) | — | I-15 | II-9 | 185 | 4.5 | 10 | 60 |
| 17 | (41) | DIPN | I-18 | II-1 | 220 | 5.0 | 0 | 55 |
| 18 | (3) | — | | | | | | |
| | (17) | — | I-20 | II-11 | 215 | 4.5 | 0 | 55 |
| 19 | (3) | DIPN | I-20 | II-11 | 230 | 5.0 | 5 | 50 |
| | (41) | DES | | | | | | |

*"Dot quality" as used in the present examples means an estimated value of reproduced dot images and reproduction of a clear individual dot is observed at 50% density (namely, an intermediate part between shadow dot and highlight dot). That is, "5" means an extremely excellent clear dot, "1" means an extremely bad dot and the dot not less than 3 can be practically permitted.

**Development lag is determined by seperate measurements of the respective optimum developing times for the shadow dot part and the highlight dot part and expressed in terms of seconds for the difference between the measured times. Generally, the highlight dot has a more rapid developing ability.

***Replenished amount after development represents a rate of the amount required for activation to a desired level by preparing a replenishing solution separately and adding it to a waste developer in order to restore an activity of a developer when the developer shows a definite fatigue, i.e., a lowered activity in a complete blackening of the above-mentioned film. The less value is preferable. And, "DES" means diethylhexylsuccinate sulfonic acid and "DIPN" means diisopropylnaphthosulfonic acid.

As apparent from the above Table 1, the photographic material of this invention shows a remarkable sensitization, a highly excellent dot quality and an individual high dot density upon little or no observed slur of development (namely, a long exposure range). This suggests a good etchability and the test by the present inventors has shown that a great etchability can be accomplished.

Also, a sufficiently little replenished amount of a developer shows a considerable, ecconomical merit.

EXAMPLE 2

Into 1 l of a 2% aqueous gelatin solution were poured at once the following two liquids over 1 minute. The temperature of the liquid was 55° C.

| | |
|---|---|
| Solution III: | |
| Potassium bromide | 43g |
| Potassium iodide | 2g |
| Water | q.s. to make up 250ml |
| Solution IV: | |
| Silver nitrate | 60g |
| Water | q.s. to make up 200ml |
| Aqueous ammonia | q.s to make a clear solution |

After 3 minutes from completion of the addition of the Solutions (III) and (IV), physical ripening was accomplished and then excess salts were removed by decantation. This emulsion was chemically ripened by the action of gold and sulfur sensitizers in the presence of a Rhodanate. Subsequently, 500 mg of 4-hydroxy-6-methyl-1,3,3a,7-tetrazaindene and 100 mg of the above-named polyethylene oxide compound (f) ($R^4$ is an alkyl group of 4 carbon atoms, $n_8=60$ and $l_5=2$) were added thereto and then $5\times10^{-3}$ mole of the tetrazolium compound shown in the Table 2 (as a 1.5% methanolic solution thereof) (where 2 sorts of the salts of tetrazolium were used together, each $2.5\times10^{-3}$ mole portion; where the sensitizing dye of this invention was used alone, $2\times10^{-4}$ mole portion; where 2 sorts of the present dyes were used together, each $1\times10^{-4}$ mole portion) was added thereto. Then, the resulting emulsion was coated upon a polyethylene terephthalate support so as to contain 45 mg of silver/100 $cm^2$ and then a gelatin layer was coated thereupon so as to contain 15 mg of gelatin/100 $cm^2$. These films were wedge-exposed with a xenon single pulse ($10^{-4}$ second) and then treated in the same manner as in Example 1 except for the exposure time. In this Example, a developer having the following composition was employed and the development time was 30 seconds.

| | |
|---|---|
| Phenidone | 0.6 g |
| Hydroquinone | 9 g |
| Anhydrous sodium sulfite | 60 g |
| Sodium carbonate monohydrate | 54 g |
| 5-Nitrobenztriazole | 120 mg |
| Potassium bromide | 2.5 g |
| Water | q.s. to make up 1l (pH 10.20) |

TABLE 2

| Sample No. | Salt of tetrazolium | Anion | Sensitizing dye | | | Relative sensitivity | Gamma | Rate of replenished amount of developer |
|---|---|---|---|---|---|---|---|---|
| 20 | (3) | — | — | — | — | 100 | 9 | 100 |

TABLE 2-continued

| Sample No. | Salt of tetrazolium | Anion | Sensitizing dye | | Relative sensitivity | Gamma | Rate of replenished amount of developer |
|---|---|---|---|---|---|---|---|
| 21 | (3) | — | I-3 | — | 140 | 11 | 80 |
| 22 | (3) | — | — | II-3 | 140 | 11 | 80 |
| 23 | (3) | — | I-3 | II-3 | 185 | 13 | 65 |
| 24 | (3) | SDS | I-3 | II-3 | 200 | 15 | 60 |
| 25 | (18) | — | I-5 | II-4 | 220 | 14 | 65 |
| 26 | (18) | DES | I-7 | II-5 | 220 | 15 | 65 |
| 27 | (27) | DIPN | I-12 | II-7 | 180 | 12 | 70 |

As apparent from the above Table 2, the photographic material of this invention shows a remarkable sensitizing effect even with a high intensity of illumination and a short exposure and a superior gamma in a line- or dot-image even with silver iodobromide, which shows a usefulness as a photographic material for fascimile.

In addition, the present material is also excellent as a photographic material for rapid treatment, as an induction period of development is short and a satisfactory blackness is attained in about 30 seconds.

What is claimed is:

1. A high-contrast light-sensitive silver halide photographic material which comprises a support and (i) at least one light-sensitive silver halide emulsion layer containing silver halide and (ii) another hydrophilic colloidal layer coated on the support, at least one of said silver halide emulsion layer and another hydrophilic colloidal layer contains at least one tetrazolium salt selected from those of the general formula VI, VII and VIII

VI

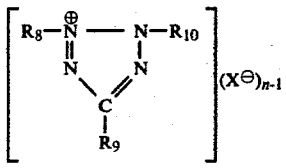

VII

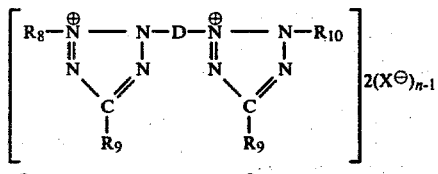

VIII

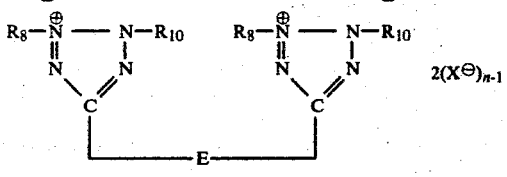

wherein $R_8$ and $R_{10}$ individually represent an alkyl group, an alkenyl group, an aryl group or a heterocyclic group or they may be a group capable of forming a metal chelate or complex; $R_9$ represents a hydroxy, carboxyl or a salt thereof, an alkoxycarbonyl group, a group of $—SR_{11}$ in which $R_{11}$ is a hydrogen atom, an alkyl group or an aryl group, nitro, a hydrogen atom, an amino group, an alkyl group, an alkenyl group or an aryl group; D represents a divalent aromatic group; E represents an alkylene group, an arylene group or an aralkylene group; $X^{\ominus}$ represents an anion, n is 1 or 2, provided that said salt forms an intramolecular salt when n is 1 said at least one silver halide emulsion layer contains (iii) at least one dye of the general formula I and (iv) at least one dye of the general formula II, which follow

I

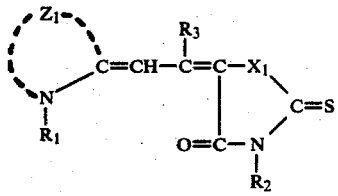

wherein $Z_1$ represents a group of non-metallic atoms forming a thiazole ring, a selenazole ring, an oxazole ring, an imidazole ring, a benzthiazole ring, a benzselenazole ring, a benzoxazole ring, a benzimidazole ring, a naphthothiazole ring, a naphthoselenazole ring, a naphthoxazole ring or a naphthoimidazole ring; $X_1$ represents an oxygen atom, a sulfur atom, a selenium atom or a group of $N—R_4$ in which $R_4$ is a lower alkyl group, an alkenyl group or an aryl group; $R_1$ and $R_2$ individually represent a lower alkyl group, an alkenyl or an aryl group; and $R_3$ represents a hydrogen atom, a lower alkyl group, an alkenyl group or an aryl group; and

II

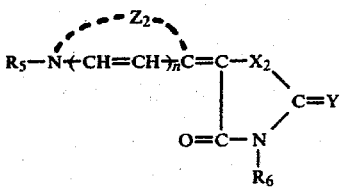

wherein $Z_2$ represents a group of non-metallic atoms forming a 5- or 6-membered heterocyclic ring optionally having a substituent; $X_2$ represents an oxygen atom, a sulfur atom, a selenium atom or a group of $N—R_7$ in which $R_7$ represents a lower alkyl group, an alkenyl group or an aryl group; Y represents an oxygen atom or a sulfur atom; $R_5$ and $R_6$ individually represent a lower alkyl group, an alkenyl group or an aryl group; and n is 0 or 1.

2. A light-sensitive silver halide photographic material according to claim 1 wherein said compound of the general formula (I) is selected from the compounds of the general formula (III) and said compound of the general formula (II) is selected from the compounds of the general formula (IV) or (V);

the general formula (III)

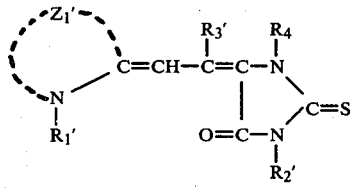

wherein $Z'_1$ represents a group of non-metallic atoms which is required to form a benzoxazole ring; $R'_1$ represents a lower alkyl group; $R'_2$ and $R_4$ individually represent a lower alkyl group or an aryl group; and $R'_3$ represents a hydrogen atom, a lower alkyl group or a phenyl group;

the general formula (IV)

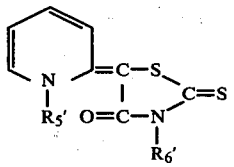

the general formula (V)

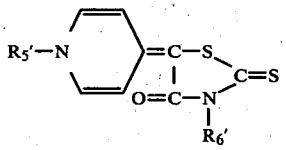

wherein $R'_5$ represents a lower alkyl group, $R'_6$ represents a lower alkyl group, an alkenyl group or an aryl group.

3. A light-sensitive silver halide photographic material according to claim 2 wherein said compound of the general formula (III) is the compound of the formula (a), said compound of the general formula (IV) is the compound of the formula (b) and said compound of the general formula (V) is the compound of the formula (c);

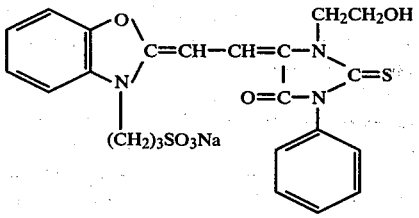

(a)

-continued

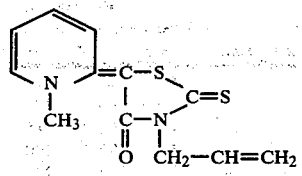

(b)

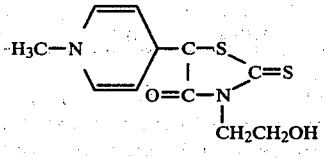

(c)

4. A light-sensitive silver halide photographic material according to claim 1 wherein $X^{\ominus}$ represents a higher alkylbenzenesufonic acid anion, a dialkyl sufosuccinate anion, a polyether alcohol sulfuric acid ester anion a higher aliphatic acid anion or a polymer having an acid radical.

5. A light-sensitive silver halide photographic material according to claim 4 wherein $X^{\ominus}$ represents a p-dodecylbenzenesulfonic acid anion, a lauryl sulfate anion, a di-2-ethyl-hexylsufosuccinate anion a cetyl polyethenoxy sulfate anion, stearic acid anion or polyacrylic acid anion.

6. A light-sensitive silver halide photographic material according to claim 1 wherein $R_3$, $R_9$ and $R_{10}$ individually represent an aryl group.

7. A light-sensitive silver halide photographic material according to claim 6 wherein said aryl group is a phenyl or naphtyl group.

8. A light-sensitive silver halide photographic material according to claim 1 wherein $R_3$, $R_9$ and $R_{10}$ individually represent an aryl group, $X^{\ominus}$ represents an higher alkylbenzenesulfonic acid anion a dialkylsulfonosuccinate anion, a polyether alcoholsulfuric acid ester anion, a higher aliphatic acid anion, or a polymer having an acid radical.

9. A light-sensitive silver halide photographic material according to claim 8 wherein $R_3$, $R_9$ and $R_{10}$ individually represent a phenyl group, $X^{\ominus}$ represents a di-2-ethyl-hexylsufosuccinate anion.

10. A light-sensitive silver halide photographic material according to claim 1 wherein the silver halide contained in said silver halide emulsion layer are silver halide grains having an average grain size of 0.05 to 1.5μ and at least 60% of said grains are in the range of 0.6 to 1.4 times the average grain size.

11. A light-sensitive silver halide photographic material according to claim 1 wherein the silver halide contained in said silver halide emulsion layer are silver chlorobromide or silver chloroiodobromide grains having an average grain size of 0.1 to 0.5μ, at least 60% of said grains are in the range of 0.6 to 1.4 times the average grain size, and said grains are cubic.

12. A light-sensitive silver halide photographic material according to claim 1 wherein said hydrophilic colloidal layer is a gelatin layer.

* * * * *